US012791284B2

(12) United States Patent
Sun et al.

(10) Patent No.: US 12,791,284 B2
(45) Date of Patent: Nov. 10, 2026

(54) LED MOUNTING BASE FOR RED DOT SIGHT

(71) Applicant: HUANIC CORPORATION, Xi'an (CN)

(72) Inventors: Jianhua Sun, Xi'an (CN); Yaofeng Zhao, Xi'an (CN)

(73) Assignee: HUANIC CORPORATION, Xi'an (CN)

( * ) Notice: Subject to any disclaimer, the term of this patent is extended or adjusted under 35 U.S.C. 154(b) by 269 days.

(21) Appl. No.: 18/715,696

(22) PCT Filed: Nov. 30, 2022

(86) PCT No.: PCT/CN2022/135708
§ 371 (c)(1),
(2) Date: Aug. 21, 2025

(87) PCT Pub. No.: WO2023/098771
PCT Pub. Date: Jun. 8, 2023

(65) Prior Publication Data

US 2026/0118090 A1 Apr. 30, 2026

(30) Foreign Application Priority Data

Dec. 1, 2021 (CN) ..... 202122991352.6

(51) Int. Cl.
*F41G 1/30* (2006.01)
*F41G 1/34* (2006.01)

(52) U.S. Cl.
CPC *F41G 1/30* (2013.01); *F41G 1/34* (2013.01)

(58) Field of Classification Search
CPC ..... F41G 1/30; F41G 1/34
See application file for complete search history.

(56) References Cited

U.S. PATENT DOCUMENTS 7,526,890 B1 5/2009 Keng et al.
8,984,795 B2 * 3/2015 Jung ..... F41G 1/30 42/137

(Continued)

FOREIGN PATENT DOCUMENTS

CN 2552025 Y 5/2003
CN 108581542 A 9/2018

(Continued)

OTHER PUBLICATIONS

PCT/CN/2022/135708 International Search Report.
JP2024-532496—Notice of Allowance with English.

*Primary Examiner* — Michelle Clement
(74) *Attorney, Agent, or Firm* — Thomas Horstemeyer, LLP

(57) ABSTRACT

An LED mounting base for a red dot sight comprising an LED mounting block, a first mounting base is arranged at the left rear of the LED mounting block. A first limiting block base is provided at the left of the first mounting base. A first slope is provided on the first limiting block base, and a second slope is provided on the first mounting base. On the first mounting base is a first adjusting assembly having a first ejector block provided at the left and a second ejector block provided at the right. A third slope is arranged below the first ejector block and abuts against the first slope. A fourth slope is arranged below the first adjusting assembly and abuts against the second slope. An elastic member is arranged below the first adjusting assembly. A first adjusting knob is arranged at the right of the second ejector block.

4 Claims, 3 Drawing Sheets

(56) References Cited

U.S. PATENT DOCUMENTS

| | | | | |
|---|---|---|---|---|
| 9,010,008 | B2 | 4/2015 | Hovey | |
| 10,006,741 | B2 * | 6/2018 | Jeung | F41G 3/00 |
| 10,598,463 | B2 * | 3/2020 | Jeung | F41G 1/345 |
| 10,655,933 | B2 * | 5/2020 | Jeung | F41G 3/00 |
| 11,150,051 | B2 * | 10/2021 | Connolly | F41G 1/387 |
| 11,788,815 | B2 * | 10/2023 | Connolly | F41G 1/387 42/113 |
| 12,253,336 | B1 * | 3/2025 | Li | F41G 3/08 |
| 12,429,304 | B2 * | 9/2025 | Niswander | F41G 1/16 |
| 12,467,717 | B2 * | 11/2025 | Sheets, Jr. | F41G 1/30 |
| 12,517,341 | B2 * | 1/2026 | Crispin | G02B 23/16 |
| 2010/0162611 | A1 | 7/2010 | Samson et al. | |
| 2018/0045486 | A1 | 2/2018 | Jeung et al. | |
| 2018/0195835 | A1 * | 7/2018 | Crispin | F41G 1/30 |
| 2024/0200908 | A1 * | 6/2024 | Fuller | F41G 1/30 |
| 2025/0035913 | A1 * | 1/2025 | Sun | F41G 1/30 |
| 2025/0334374 | A1 * | 10/2025 | Sun | F41G 1/36 |
| 2026/0043635 | A1 * | 2/2026 | Sheets, Jr. | F41G 1/30 |
| 2026/0118090 | A1 * | 4/2026 | Sun, Sr. | F41G 1/30 |

FOREIGN PATENT DOCUMENTS

| | | | |
|---|---|---|---|
| CN | 109931816 | A | 6/2019 |
| CN | 110966891 | A | 4/2020 |
| CN | 112082426 | A | 12/2020 |
| CN | 216523417 | U | 5/2022 |
| JP | 2021-528623 | A2 | 10/2021 |
| JP | 2023-543505 | A2 | 10/2023 |
| KR | 101375373 | | 3/2014 |

* cited by examiner

LED MOUNTING BASE FOR RED DOT SIGHT

CROSS REFERENCE

This application is a National Stage application of PCT/CN2022/135708, filed on Nov. 30, 2022, which claims the benefit of Chinese Application No. 202122991352.6, filed on Dec. 1, 2021, both of which are incorporated herein by reference in their entirety.

TECHNICAL FIELD

The present disclosure belongs to the technical field of sight components, and in particular, relates to an LED mounting base for a red dot sight.

BACKGROUND

In order to improve the shooting accuracy and adapt to different shooting situations or targets, it is necessary to adjust the emission angle of the LED light source of the red dot sight, and a method of combined adjusting screws and reset springs is generally adopted to achieve the adjustment of the pitch angle or the left-right angle of the emission angle of the LED light source. Especially when the up-down adjustment mechanism operates independently, there is an inevitable defect of mutual interaction that the adjustment of the left-right angles affects the adjustment of the pitch angle, resulting in a low precision, instability and thereby causing a decrease in the good user experience. For instance, the Chinese patent application No. 202011064636.4 discloses an adjustment mechanism and a red dot sight thereof, in which the up-down adjustment mechanism still has problems of having many components, a high manufacturing cost, and a relatively large volume which is unfavorable for a miniaturization use.

SUMMARY

The present disclosure is to solve the problems that the up and down adjustment mechanism of the existing LED mounting base for a red dot sight still has many components, a high manufacturing cost, and a relatively large volume which is unfavorable for a miniaturized use.

An LED mounting base for a red dot sight described in the present disclosure includes an LED mounting block, where a first mounting base is provided at the rear left of the LED mounting block, a first limiting block base is arranged at the left of the first mounting base, a first slope is provided at the top of the first limiting block base, a second slope is provided at the right end of the first mounting base, a first adjusting assembly is arranged on the first mounting base, a first ejector block is provided in the left of the first adjusting assembly, a third slope is provided at the bottom of the first ejector block, the third slope abuts against the first slope, a fourth slope is provided in the middle of the bottom of the first adjusting assembly, the fourth slope abuts against the second slope, an elastic piece is further arranged below the first adjusting assembly, a second ejector block is provided in the right of the first adjusting assembly, and a first adjusting knob is arranged on the right side of the second ejector block.

Further, a first mounting groove is provided in the front of the LED mounting block, a mounting block is provided at the left end of the first mounting groove, a second adjusting knob is arranged on the mounting block, an LED base is set within the first mounting groove, an left end of the LED base abuts against the second adjusting knob, a spring base is provided on a right end of the LED base, a first spring is arranged on the spring base, one end of the first spring is in contact with the spring base and the other end of the first spring is in contact with a right wall of the first mounting groove, a second mounting groove is provided in the middle of the top of the LED base, and a light source is set within the second mounting groove.

Further, two first mounting holes are provided at the top of the LED base, the two first mounting holes are respectively located at the left and right sides of the second mounting groove, a blocking column is set in each of the two first mounting holes, and a second spring is arranged around the blocking column, two second mounting holes are further provided in the front of the LED base, the two second mounting holes are respectively located at the left and right sides of the second mounting groove, a sliding column is set in each of the two second mounting holes, and a third spring is arranged around the sliding column.

Further, a pad plate assembly is further provided in the middle of the front of the LED base.

The present disclosure provides the following beneficial effects: By means of the first mounting base, the first adjusting assembly, the elastic piece, and the first adjusting knob provided at the left rear of the LED mounting block, the position of the first adjusting assembly can be adjusted by the rotation of the first adjusting knob, and the up-down adjustment of the LED mounting base can be achieved with the cooperation of the first mounting base and the elastic piece. The LED mounting base for a red dot sight provided by the present disclosure not only has a simple structure and less mounting components, which is conducive to reducing the manufacturing cost, but also has a high structural stability and precision when the upward and downward adjustment is performed, which is conducive to improving the accuracy of the sight.

The present disclosure will be further described in detail below with reference to embodiments as follows.

Figure 1:
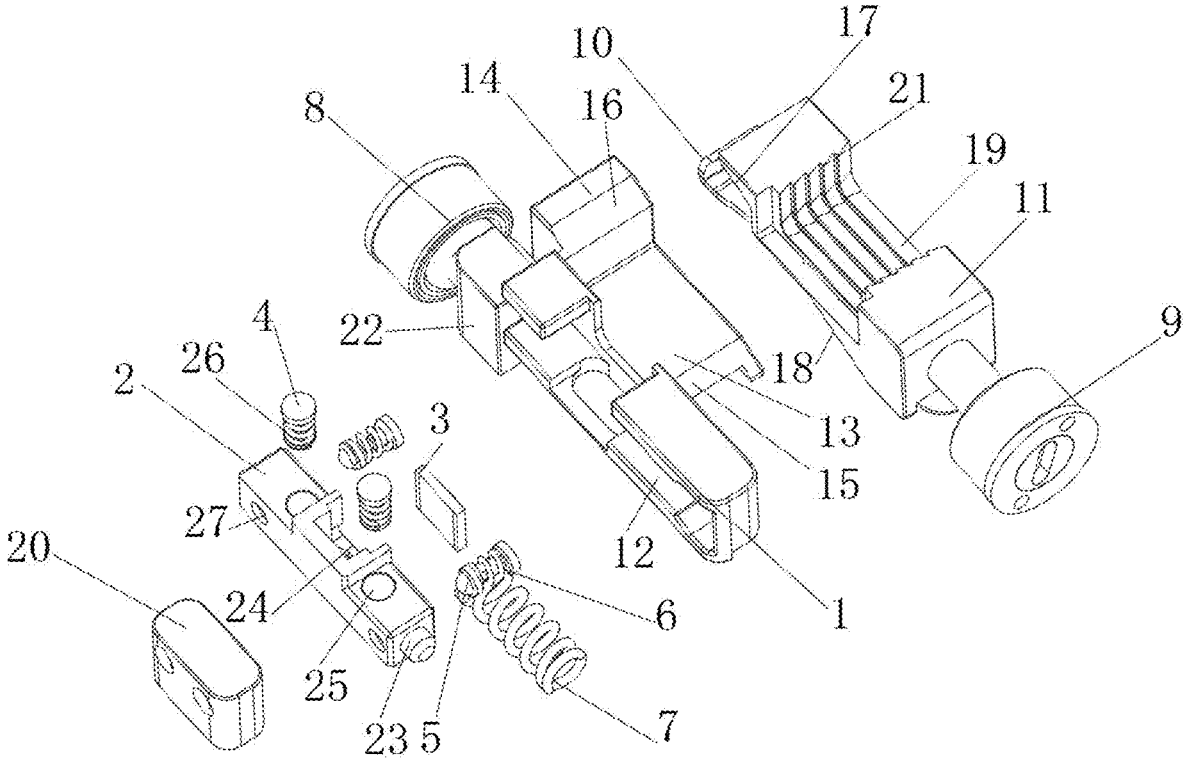
FIG. 1 is a structural schematic view of a LED mounting base for a red dot sight in a disassembled state.
Figure 2:
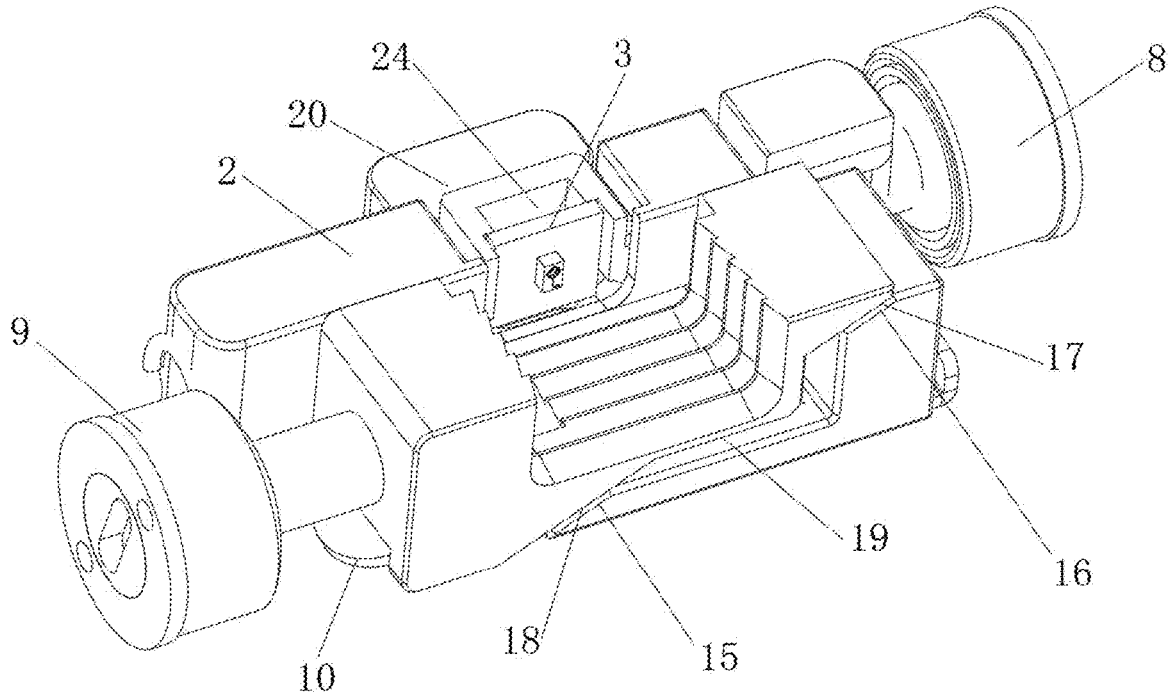
FIG. 2 is a structural schematic view of the LED mounting base for a red dot sight in an assembled state.
Figure 3:
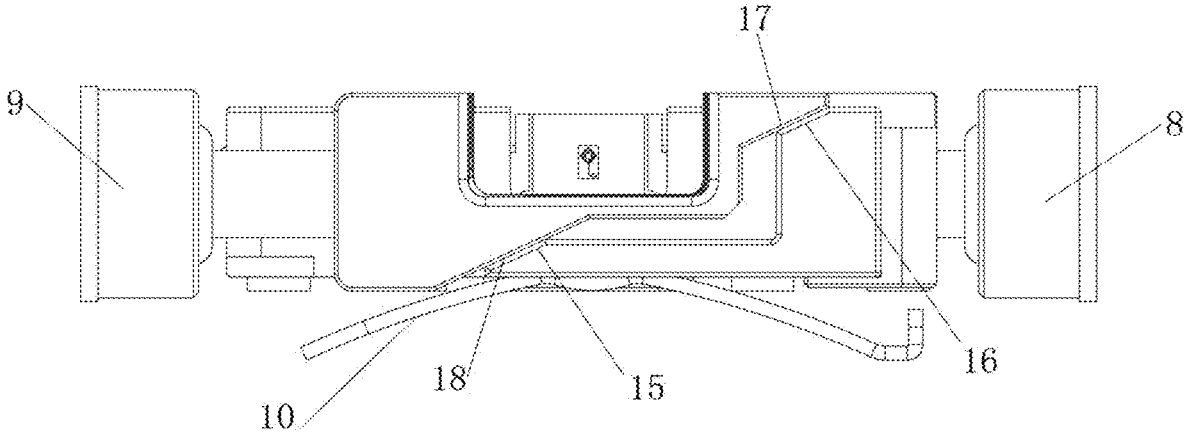
FIG. 3 is a front side schematic view of the assembled LED mounting base for a red dot sight.

In the drawings: 1. LED mounting block; 2. LED base; 3. Light source; 4. Blocking column; 5. Sliding column; 6. Third spring; 7. First spring; 8. Second adjusting knob; 9. First adjusting knob; 10. Elastic piece; 11. Second ejector block; 12. First mounting groove; 13. First mounting base; 14. First limiting block base; 15. Second slope; 16. First slope; 17. Third slope; 18. Fourth slope; 19. First adjusting assembly; 20. Pad plate assembly; 21. First ejector block; 22. Mounting block; 23. Spring base; 24. Second mounting groove; 25. First mounting hole; 26. Second spring; 27. Second mounting hole; 28. Sight housing; 29. Screw sleeve.

DETAILED DESCRIPTION

In order to further elaborate the technical means adopted by the present disclosure to achieve the intended purpose and the effects thereof, the specific implementation, structural features and effects thereof of the present disclosure are to be described in detail below with reference to the drawings and the embodiments.

Hereinafter, the technical solutions of the embodiments of the present disclosure will be clearly and completely described with reference to the accompanying drawings of the embodiments of the present disclosure. Obviously, the described embodiments are only some of the embodiments of the present disclosure, but not all of them. Based on the embodiments of the present disclosure, all other embodiments obtained by those of ordinary skill in the art without paying creative efforts fall within the scope of protection of the present disclosure.

In the description of the present disclosure, it should be understood that the orientations or positional relationships indicated by the terms such as "center", "upper", "lower", "front", "rear", "left", "right", "vertical", "horizontal", "align", "overlap", "bottom", "inside", "outside", etc., are orientations or positional relationships shown based on the accompanying drawings, and are used only for the purpose of facilitating the description of the present disclosure and simplifying the description, and are not intended to indicate or imply that the apparatus or element referred to must have a specific orientation, or be constructed and operated in a particular orientation, thus they are not to be construed as a limitation of the present disclosure.

The terms "first" and "second" are used for descriptive purposes only and are not to be understood as indicating or implying any relative importance or implicitly specifying the number of the technical features indicated. Therefore, the features defined with "first" and "second" may explicitly or implicitly include one or more of the features; in the description of the present disclosure, unless otherwise stated, the meaning of "plurality" is two or more.

Embodiment 1

In order to solve the problems that the up and down adjustment mechanism of the existing LED mounting base for a red dot sight still has many components, a high manufacturing cost, and a relatively large volume which is unfavorable for a miniaturized use, the present embodiment provides an LED mounting base for a red dot sight as shown in FIGS. 1 to 4, including an LED mounting block 1, where a first mounting. base 13 is integrally provided at the rear left of the LED mounting block 1, a first limiting block base 14 is arranged at the left of the first mounting base 13, a first slope 16 is provided at the top of the first limiting block base 14, a second slope 15 is provided on a right end of the first mounting base 13, and the first slope 16 and the second slope 15 are both configured of being high on the left and low on the right. A first adjusting assembly 19 is arranged on the first mounting base 13, a first ejector block 21 is provided at the left of the first adjusting assembly 19, a third slope 17 is provided at the bottom of the first ejector block 21, and the third slope 18 abuts against the first slope 16, Besides, a fourth slope 18 is provided in the middle of the bottom of the first adjusting assembly 19, and the fourth slope 18 abuts against the second slope 15. An elastic piece 10 is further arranged below the first adjusting assembly 19, and the elastic piece 10 is in the shape of a circular arc having an arc center below the same. the elastic piece 10 and the first adjusting assembly 19 are connected in the left of the fourth slope 18 (while from the view of FIG. 2 and FIG. 3, the connection between the elastic piece 10 and the first adjusting assembly 19 is located at the right of the fourth slope 18). A second ejector block 11 is provided at the right of the first adjusting assembly 19, and a first adjusting knob 9 is arranged on the right side of the second ejector block 11. A connecting rod of the first adjusting knob 9 is connected to the second ejector block 11 via screw thread, while the rotation of the first adjusting knob 9 can drive the first adjusting assembly 19 to move left and right. The first mounting base 13 moves up and down under the action of the pushing force of the third slope 17 against the first slope 16 and the pushing force of the fourth slope 18 against the second slope 15, which causes the LED mounting block 1 integrated with the first mounting base 13 to move up and down, and in turn causes the LED base 2 move up and down. In this way, the up and down movement of the LED mounting base for a red dot sight can be achieved, such designed configuration has a simple and stability structure, and a high precision can be obtained when up and down adjustment is performed.

Further, a first mounting groove 12 is provided at the front of the LED mounting block 1, a mounting block 22 is arranged at the left end of the first mounting groove 12, and at the right end of the mounting groove 12 a groove wall is presented. A second adjusting knob 8 is arranged on the mounting block 22 (to be specific, the second adjusting knob 8 is arranged on the left side of the mounting block 22), and the second adjusting knob 8 is connected to the mounting block via screw thread. The LED base 2 is set within the first mounting groove 12, and the second adjustment knob 8 penetrates the mounting block 22 and abuts against the LED base 2. A spring base 23 is provided on a right end of the LED base 2, and a first spring 7 is arranged at the spring base 23, one end of the first spring 7 is in contact with the spring base 23 and the other end of the first spring 7 is in contact with a right wall of the first mounting groove 12. In this way, when the second adjusting knob 8 is rotated, the second adjusting knob 8 pushes the LED base 2 to move left and right along the first mounting groove 12. A second mounting groove 24 is provided in the middle of the top of the LED base 2, and a light source 3 is set within the second mounting groove 24. The LED mounting block 1 is provided with a notch at a position corresponding to the light source 3 so that a light emitted from the light source 3 propagates forward.

Further, two first mounting holes 25 are provided at the top of the LED base 2, the two first mounting holes 25 are respectively located at left and right sides of the second mounting groove 24, a blocking column 4 is set in each of the two first mounting holes 25, and a second spring 26 is arranged around the blocking column 4. The blocking column 4 is helpful to reducing the resistance between the LED base 2 and the first mounting groove 12, so as to improve the smoothness of movement of the small LED base 2 when being moved left and right along the first mounting groove 12, and at the same time the blocking column can eliminate the fit gap caused by errors of parts. Two second mounting holes 27 are further provided in the front of the LED base 2, a sliding column 5 is set in each of the two second mounting holes 27, and a third spring 6 is arranged around the sliding column 5. The arrangement of the blocking column 4 and the sliding column 5 makes the left and right sliding of the LED base 2 in the first mounting groove 12 more stable, which can ensure the smoothness of the left and right movement of the LED base 2.

In addition, a pad plate assembly 20 is further provided at the center of the front of the LED base 2. The pad plate assembly 20 can increase the stability of the LED base 2, and under the action of the pad plate assembly 20, the LED base 2 can slide better in the first mounting groove 12.

Figure 4:
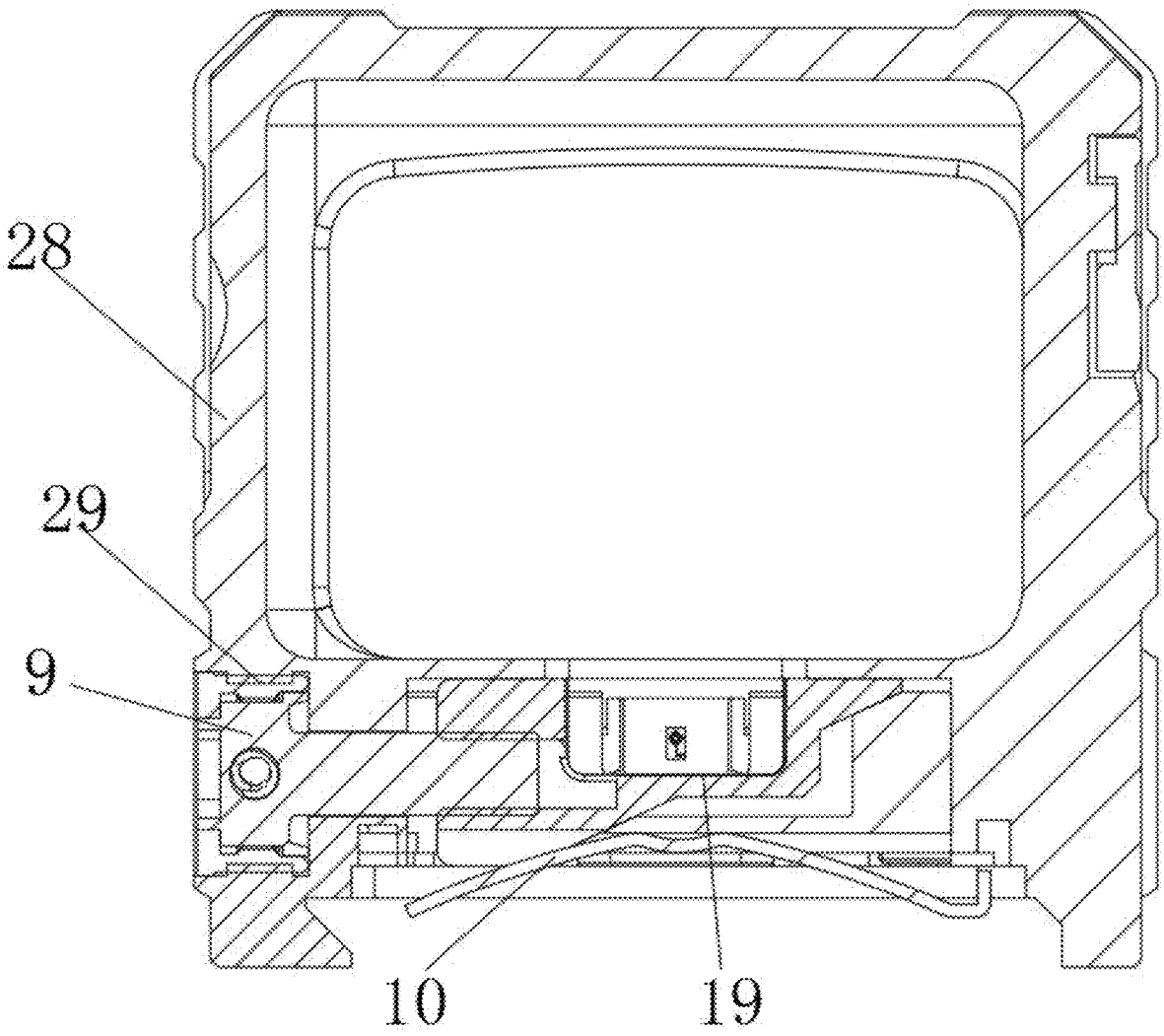
FIG. 4 is a structural schematic view of the LED mounting base for a red dot sight, in which the LED mounting base is set in the sight.

FIG. 4 is a structural schematic view of the LED mounting base for a red dot sight in which the LED mounting base is set in the sight. A screw sleeve 29 is provided in a sight housing 28. The first adjusting knob 9 is under the limiting effect of the screw sleeve 29, and the screw sleeve 29 is tightened to the sight housing 28 to position the first adjusting knob 9. In this way, when the first adjusting knob 9 is rotated, the first adjusting knob 9 will not be displaced due to the limiting effect of the screw sleeve 29, while the second ejector block 11 connected to the first adjusting knob 9 via screw thread will be displaced, thereby driving the first adjusting assembly 19 to move left and right. That is, when the first adjusting knob 9 is rotated, the first adjusting knob 9 will not be displaced, while the first adjusting assembly 19 connected to the first adjusting knob 9 via screw thread will move left and right. The first mounting base 13 moves up and down under the action of the force of the third slope 17 against the first slope 16 and the force of the fourth slope 18 against the second slope 15, which causes the LED mounting block 1 integrated with the first mounting base 13 to move up and down, and further causes the LED base 2 move up and down. In this way, the up and down movement of the LED mounting base for the red dot sight can be achieved, such designed configuration has a simple and stability structure, and a high precision can be obtained when up and down adjustment is performed.

In summary, by means of the first mounting base, the first adjusting assembly, the elastic piece, and the first adjusting knob provided at the left rear of the LED mounting block, the position of the first adjusting assembly can be adjusted by the rotation of the first adjusting knob, and the up-down adjustment of the LED mounting base can be achieved with the cooperation of the first mounting base and the elastic piece. The LED mounting base for a red dot sight not only has a simple structure and less mounting components, which is conducive to reducing the manufacturing cost, but also has a high structural stability and precision when the upward and downward adjustment is performed, which is conducive to improving the accuracy of the sight.

The above content is a further detailed description of the present disclosure in combination with specific preferred embodiments, and it cannot be concluded that the specific implementation of the present disclosure is limited to these descriptions. For those of ordinary skill in the technical field to which the present disclosure belongs, several simple deductions or substitutions can be made without departing from the concept of the present disclosure, which should be regarded as falling within the protection scope of the present disclosure.

What is claimed is:

1. An LED mounting base for a red dot sight, comprising an LED mounting block, wherein a first mounting base is provided at the rear left of the LED mounting block, a first limiting block base is arranged at the left of the first mounting base, a first slope is provided at the top of the first limiting block base, a second slope is provided at the right end of the first mounting base, a first adjusting assembly is arranged on the first mounting base, a first ejector block is provided in the left of the first adjusting assembly, a third slope is provided at the bottom of the first ejector block, the third slope abuts against the first slope, a fourth slope is provided in the middle of the bottom of the first adjusting assembly, the fourth slope abuts against the second slope, an elastic piece is further arranged below the first adjusting assembly, a second ejector block is provided in the right of the first adjusting assembly, and a first adjusting knob is arranged on the right side of the second ejector block.

2. The LED mounting base for a red dot sight according to claim 1, wherein a first mounting groove is provided in the front of the LED mounting block, a mounting block is provided at the left end of the first mounting groove, a second adjusting knob is arranged on the mounting block, an LED base is set within the first mounting groove, an left end of the LED base abuts against the second adjusting knob, a spring base is provided on a right end of the LED base, a first spring is arranged on the spring base, one end of the first spring is in contact with the spring base and the other end of the first spring is in contact with a right wall of the first mounting groove, a second mounting groove is provided in the middle of the top of the LED base, and a light source is set within the second mounting groove.

3. The LED mounting base for a red dot sight according to claim 2, wherein two first mounting holes are provided at the top of the LED base, the two first mounting holes are respectively located at the left and right sides of the second mounting groove, a blocking column is set in each of the two first mounting holes and a second spring is arranged around the blocking column, two second mounting holes are further provided in the front of the LED base, the two second mounting holes are respectively located at the left and right sides of the second mounting groove, a sliding column is set in each of the two second mounting holes, and a third spring is arranged around the sliding column.

4. The LED mounting base for a red dot sight according to claim 2, wherein a pad plate assembly is further provided in the middle of the front of the LED base.

* * * * *